US006073968A

United States Patent [19]

Casper

[11] Patent Number: 6,073,968

[45] Date of Patent: Jun. 13, 2000

[54] SECURITY FEATURES FOR A DECAL

[75] Inventor: Mark S. Casper, Williamsville, N.Y.

[73] Assignee: Moore U.S.A., Inc., Grand Island, N.Y.

[21] Appl. No.: 09/059,398

[22] Filed: Apr. 14, 1998

[51] Int. Cl.[7] ..... B42D 15/00

[52] U.S. Cl. ..... 283/96; 283/95; 283/91; 283/94

[58] Field of Search ..... 162/140, 134, 162/181.9; 283/91, 94, 95, 57–59, 96, 74; 428/913, 914, 915, 916, 920

[56] References Cited

U.S. PATENT DOCUMENTS

| | | | |
|---|---|---|---|
| 1,652,042 | 12/1927 | Neff | 428/29 |
| 3,400,003 | 9/1968 | Guertin | 428/29 |
| 3,413,171 | 11/1968 | Hannon | 428/448 |
| 3,749,923 | 7/1973 | Husome | 250/223 |
| 3,873,390 | 3/1975 | Cornell et al. | 156/230 |
| 4,092,449 | 5/1978 | Bernstein | 428/29 |
| 4,246,307 | 1/1981 | Trautwein | 428/43 |
| 4,677,010 | 6/1987 | Selwyn . | |
| 4,942,410 | 7/1990 | Fitch et al. | 346/160.1 |
| 4,958,173 | 9/1990 | Fitch et al. | 355/252 |
| 5,102,737 | 4/1992 | Josephy et al. | 428/411.1 |
| 5,161,829 | 11/1992 | Detrick et al. | 281/91 |
| 5,270,103 | 12/1993 | Oliver et al. | 428/219 |
| 5,312,522 | 5/1994 | Van Phan et al. | 162/111 |
| 5,313,373 | 5/1994 | Bjorner et al. | 362/293 |
| 5,362,554 | 11/1994 | Holzer et al. | 428/283 |
| 5,379,131 | 1/1995 | Ymazaki | 359/2 |
| 5,407,234 | 4/1995 | Rettker et al. | 283/62 |
| 5,449,200 | 9/1995 | Andric et al. | 283/67 |
| 5,496,072 | 3/1996 | Yamauchi et al. | 283/86 |
| 5,510,199 | 4/1996 | Martin . | |
| 5,513,019 | 4/1996 | Cueli | 359/2 |
| 5,578,365 | 11/1996 | Kume et al. | 428/195 |
| 5,605,738 | 2/1997 | Mc Giness et al. | 428/195 |
| 5,656,369 | 8/1997 | Chess et al. | 428/331 |
| 5,683,855 | 11/1997 | Shinkai et al. | 430/270.11 |
| 5,744,207 | 4/1998 | Bartusiak et al. | 428/448 |
| 5,770,283 | 6/1998 | Gosselin et al. | 428/35.7 |
| 5,820,971 | 10/1998 | Kaule et al. | 428/209 |
| 5,830,609 | 11/1998 | Warner et al. | 430/10 |

FOREIGN PATENT DOCUMENTS

| | | |
|---|---|---|
| 2321159 | 3/1977 | France . |
| WO9804419 | 2/1998 | WIPO . |

*Primary Examiner*—Willmon Fridie, Jr.
*Attorney, Agent, or Firm*—Nixon & Vanderhye P.C.

[57] ABSTRACT

A business document contains a removable decal. The decal has a plastic substrate overlaid with a reflective coating including an aluminum coating and glass beads. A toner receptor coating overlies the reflective coating. A fine screen pattern is printed on the toner coating and which pattern may include jagged lines or closely spaced dots. Variable and non-variable information is then printed on the toner receptive coating. In the event of use of a solvent to alter the printed information on the decal, the fine printed screen pattern is likewise disrupted and evidences alteration of the decal.

9 Claims, 1 Drawing Sheet

SECURITY FEATURES FOR A DECAL

TECHNICAL FIELD

The present invention relates to a decal having printed information thereon and a security feature for the decal wherein application of a solvent to remove the printed information also disrupts the security feature thereby evidencing tampering with or an alteration of the printed information.

BACKGROUND

There are many circumstances in which it is desirable to prevent tampering with information printed on a substrate. For example, various types of security features have been provided for various documents such as currency. With the advent of modern color copiers, various types of documents are readily counterfeited, with substantial resulting losses incurred by businesses. One area that has not been addressed from the standpoint of providing a security document which will evidence alteration of the document should printed information thereon be altered is the area of decals. More particularly and for example, decals are oftentimes used in the process of registering an automotive vehicle wherein a form, i.e., the registration, is provided the vehicle owner with an attached decal. The decal is removed from the form and applied to the vehicle license plate. Oftentimes, the use of decals applied to license plates indicate the payment of vehicle registration fees. Typically, the decals are printed with the state and year of registration or state and year of registration expiration. The printing process may include any one of a number of different processes wherein a toner receptive coating is overprinted on the decal substrate using laser, ion deposition, ink jet or other processes. However, it is recognized, for example, that laser-printed decals are relatively easy to modify by removing the toner and reprinting the necessary information such as the state and year date of registration expiration. Consequently, to avoid payment of additional registration fees for forthcoming years, individuals have been found to apply a solvent to the surface of the decal which removes the toner and, hence, the printing, enabling the decal to be reprinted without authorization. In the case of automobile license decals, many different types of solvents are readily available for removing the toner, such as gasoline, bleaches, alcohol, methylethyl ketone, toluene, turpentine or brake fluid. Any other strong solvent could typically remove the toner from the underlying substrate.

DISCLOSURE OF THE INVENTION

According to the present invention, there is provided a security document, e.g., an automotive registration business form with an attached decal having printed information thereon, e.g., state and year of registration, which cannot be altered or removed without also affording a visible indication evidencing the alteration or removal. To accomplish the foregoing, the decal may comprise a plastic substrate, for example, formed of polyethylene or polystyrene, having an overlay of a reflective material which is commonly applied to decals. For example, the reflective material may comprise an aluminum coating with glass beads embedded in the coating. The purpose of the reflective coating is to provide high reflectivity upon minimal incident light. As conventional, a clear toner receptive coating is applied over the reflective coating for receiving the printed information, such as the state and year date of registration.

Prior to printing the latter information, however, and in accordance with the present invention, a fine screen pattern is applied to the toner receptive coating, preferably by a flexographic printing process. The applied screen pattern is a visible fine pattern which may be a series of closely spaced lines or dots which are readily visible under ambient lighting conditions. The decal is applied to a business form, for example, the registration document which will be forwarded to the vehicle owner. The decal may be applied by applying a release coating on the business form to which adhesive on the undersurface of the plastic substrate is releasably adhered. Alternatively, a release liner may be permanently adhered to the business form. In both cases, the decal with the pressure sensitive adhesive underlying the plastic substrate can be removed from the document and applied to the license plate of the vehicle. It will be appreciated, however, that the business form and decal are overprinted with information necessary to registering the vehicle. For example, variable and non-variable information may be applied to the business form and typically the state and year date of registration expiration is applied to the decal. The overprinting of this information overlies the fine screen pattern print previously applied to the toner receptive coating.

Should an individual alter the printed information on the decal by applying a solvent such as gasoline to the decal, the solvent will not only remove the printed information representing the registration information but also the fine pattern printed on the receptive coating. Consequently, the areas of the decal to which the solvent is applied are either void of the fine screen pattern or the pattern has been disrupted. It will be appreciated that the disruption of the fine screen pattern is quite visible and evidences unauthorized alteration of the decal. Even with an overprinting of the decal with different information by such individual, the fine pattern cannot be readily reproduced by the individual and, hence, the overprinting does not affect the visible indication that the decal has been altered.

In a preferred embodiment according to the present invention, there is provided a security document comprising a plastic substrate, reflective material disposed on one side of the substrate, a toner receptive coating on the one side overlying the reflective material, a visible pattern printed on the toner receptive coating and susceptible to disruption by application of a solvent to one document side and information printed on the pattern and susceptible of removal from the document by application of the solvent, an adhesive on an opposite side of the substrate from one side for securing the document to a paper substrate.

Accordingly, it is a primary object of the present invention to provide a security document bearing printed information in which an unauthorized alteration or modification of the printed information by the application of solvents to the document results in a visible indication that the document has been altered.

BEST MODE FOR CARRYING OUT THE INVENTION

Figure 1:
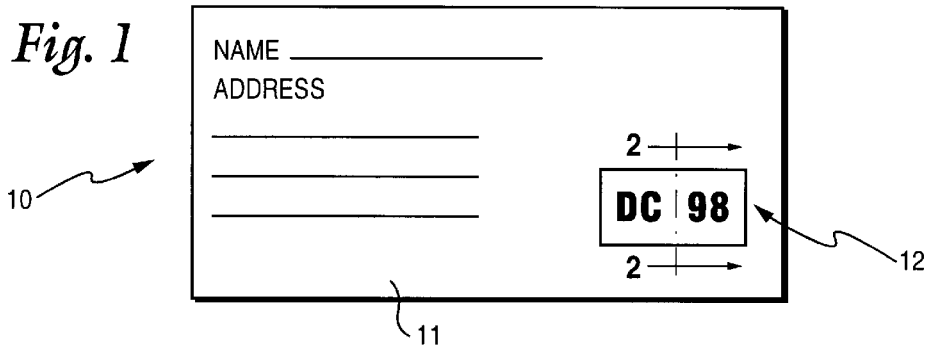
FIG. 1 is an elevational view of a business form containing a security document in accordance with the present invention.

Referring now to the drawing figures, particularly to FIG. 1, there is illustrated a business form, generally designated 10, comprising a paper substrate 11 and a security document, e.g., a decal, generally designated 12, releasably secured to paper substrate 11. The business form 10, for example, comprises a business form, for example, an automobile registration with the decal 12 being releasably secured to the paper substrate 11 for securement to the license plate of the vehicle identified by information printed on the paper substrate 11. Typically, the paper substrate 11 and decal 12 are printed together with variable and non-variable information being applied. The information printed on the decal typically comprises the state and date of registration of the vehicle.

Figure 2:
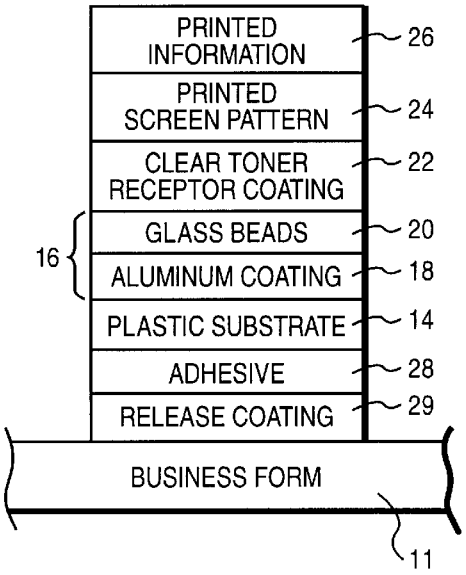
FIG. 2 is an enlarged schematic illustration of a portion of the business form bearing a decal and taken generally about on line 2—2 in FIG. 1.

Referring to FIG. 2, the paper substrate 11 of the business form 10 may comprise a single or multiple-ply form, although typically a single heavy-duty paper form is provided for purposes of serving as a registration for a vehicle. The decal 12 is comprised of a plastic substrate 14, which may be polystyrene or polyethylene, and on which is secured a reflective layer 16, preferably comprising an aluminum coating 18 and glass beads 20 in a plastic matrix. The glass beads and aluminum coating serve as a highly reflective material such that even under low light conditions, the printed information supplied on the decal is readily visible at a substantial distance. Overlying the reflective coating 16 is a clear toner receptor coating 22. This receptor coating 22 may comprise any one of a number of commercially available receptor coatings. One such available coating is described and illustrated in U.S. Pat. No. 5,437,925, of common assignee herewith. The receptor coating 22, of course, is for maintaining adherence of the toner to the substrate after printing.

Figure 4:
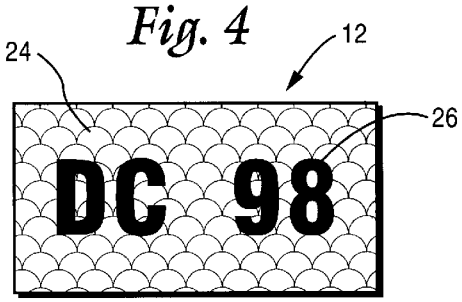
FIG. 4 is a perspective view of the decal with the fine screen printing and printed information applied.
Figure 5:
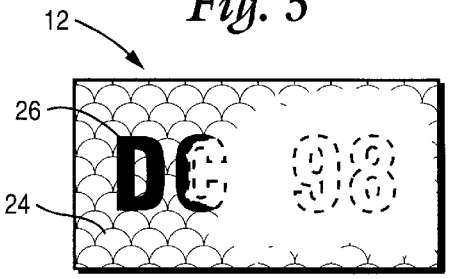
FIG. 5 is a view of the decal of FIG. 4 after application of a solvent in which the patterned screen printing has been disrupted.

In accordance with the present invention, a fine printed screen pattern 24 is applied to the receptor coating 22. A conventional flexographic printing process may be employed to apply the pattern 24. The pattern 24 itself may comprise a plurality of closely spaced lines, for example, in a jagged pattern, or a series of closely spaced dots, preferably uniformly distributed over the surface of the decal. One such pattern is illustrated in FIGS. 4 and 5. The pattern 24 is and is intended to be visible under ambient light conditions and thus would typically be in a contrasting color to the inherent color of the reflective surface 16. After printing the fine screen pattern 24, printed information 26 is printed on the substrate in overlying relation to the fine printed screen pattern 24, for example and as illustrated in FIGS. 4 and 5, the state and date of registration expiration for the vehicle identified in the attached paper substrate 11.

There are a number of ways of attaching the decal to the paper substrate 11. One way, illustrated in FIG. 2, is to provide a release coating 29 overlying the business form. It will be appreciated that the underside of the plastic substrate of the decal is provided with a pressure sensitive permanent adhesive 28 for applying the decal 12 to the vehicle license plate. Consequently, when applying the decal, the decal can be peeled or removed from the release coating 29 on the paper substrate 11 with the adhesive remaining on the underside of the decal for securing it to the vehicle license plate.

Figure 3:
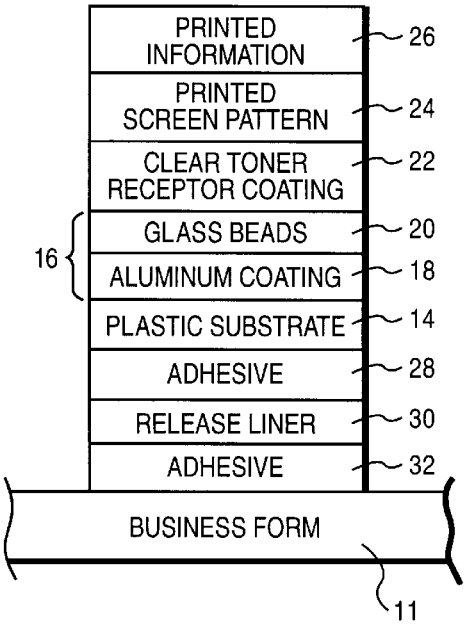
FIG. 3 is a view similar to FIG. 2 illustrating a slightly modified form of the securement between the decal and business form.

In another form of the present invention illustrated in FIG. 3, a release liner 30 may be provided and adhesively secured by permanent adhesive 32 to the paper substrate 11. The underside of the plastic substrate contains the pressure sensitive adhesive 28 whereby the decal can be removed from the release liner 30 and applied using the permanent pressure sensitive adhesive 28 to the vehicle license plate.

As illustrated in FIG. 4, after final printing and application to a vehicle license plate, the information 26 printed on the decal 12 is readily visible. Also visible are the fine screen patterns 24 on the toner receptor coating 22 and which patterns extend along through the entire visible surface of the exposed face of decal 12. Should an individual remove or attempt to remove the printed information 26 from the face of decal 12 by the application of a solvent such as gasoline, alcohol or the like, the solvent would not only remove the printed information 26 and toner receptor coating 22 but also the fine screen pattern 24 from the substrate. That is, the solvent would disrupt the pattern 24 as to render the disruption of the pattern visible under normal lighting conditions. For example, as illustrated in FIG. 5, printed information 26 which has been removed by application of a solvent is illustrated by the dashed lines. It will be appreciated that the dashed lines in the illustration of FIG. 5 are not actually extant on the decal and represent the printed information 26 which has been removed but are necessary for illustration purposes. In that area where the solvent has removed the printed information 26, it will be seen that the patterned printing 24 has also been disrupted. This clearly and visibly evidences the alteration of the decal, thereby affording evidence of tampering.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A tamper evidencing security document comprising:

a plastic substrate;

reflective material disposed on one side of said substrate;

a toner receptive coating on said one side overlying said reflective material;

a visible pattern printed on said toner receptive coating and susceptible to disruption by application of a solvent to said one document side;

information printed on said pattern and susceptible of removal from the document by application of the solvent; and an adhesive on an opposite side of said substrate from said one side for securing the document to a paper substrate;

whereby, upon application of the solvent, at least part of the printed information is removed and the pattern is disrupted, thereby visibly evidencing tampering of the security document.

2. A document according to claim 1 in combination with the paper substrate, said paper substrate having a release coating, said adhesive overlying said release coating to releasably secure the document to the paper substrate.

3. A document according to claim 1 in combination with a paper substrate having a release liner secured thereto with said adhesive overlying said release liner to releasably secure the document to the paper substrate.

4. A document according to claim 1 wherein said pattern is a screen pattern including a series of fine visible lines.

5. A document according to claim 1 wherein said reflective material includes a combination of an aluminum layer and glass beads.

6. A document according to claim 1 including information printed on said pattern and susceptible to removal by application of the solvent to said pattern, said pattern being a screen pattern including a series of fine visible lines.

7. A document according to claim 6 wherein said reflective material includes a combination of an aluminum layer and glass beads.

8. A document according to claim 1 in combination with the paper substrate, said paper substrate having a release coating, said adhesive overlying said release coating to releasably secure the document to the paper substrate, said reflective material including a combination of an aluminum layer and glass beads, and information printed on said pattern and susceptible to removal by application of the solvent to the pattern and coating.

9. A document according to claim 1 in combination with a paper substrate having a release liner secured thereto with said adhesive overlying said release liner to releasably secure the document to the paper substrate, said reflective material including a combination of an aluminum layer and glass beads, and information printed on said pattern and susceptible to removal by application of the solvent to the pattern and coating.

* * * * *